United States Patent [19]

Brålander et al.

[11] 4,055,918

[45] Nov. 1, 1977

[54] GRINDING MACHINE

[75] Inventors: Börje Brålander, Svanesund; Åke Claesson, Floda; Lars-Erik Henningsson, Goteborg; Johan Scheel, Partille, all of Sweden

[73] Assignee: Centro-Maskin Goteborg AG, Goteborg, Sweden

[21] Appl. No.: 693,741

[22] Filed: June 8, 1976

[30] Foreign Application Priority Data

June 10, 1975 Sweden ..... 7506620

[51] Int. Cl.[2] ..... B24B 7/02

[52] U.S. Cl. ..... 51/47; 51/166 MH; 51/45; 51/75; 51/34 C

[58] Field of Search ..... 51/34 C, 45, 75, 92 R, 51/92 BS, 92 ND, 166 MH; 74/242.15

[56] References Cited

U.S. PATENT DOCUMENTS

| | | | |
|---|---|---|---|
| 1,220,065 | 3/1917 | Blough | 74/242.15 R |
| 1,778,132 | 10/1930 | Wegner | 51/92 R |
| 2,308,843 | 1/1943 | Wilson | 51/92 R |
| 2,368,848 | 2/1945 | Krueger | 74/242.15 R X |
| 2,405,468 | 8/1946 | Talboys | 51/166 MH X |
| 3,641,709 | 2/1972 | Grazuit | 51/47 X |
| 3,918,209 | 11/1975 | Crawley | 51/47 X |

*Primary Examiner*—Gary L. Smith

*Attorney, Agent, or Firm*—Pierce, Scheffler & Parker

[57] ABSTRACT

A grinding machine with a movable grinding stand on a rigid frame structure where the grinding stand is rotatable on a cross travel carriage and steps are taken to prevent vibrations caused by the drive motor of the grinding wheel be propagated to the grinding wheel.

5 Claims, 3 Drawing Figures

GRINDING MACHINE

This invention relates to a grinding machine of the kind comprising a rigid frame structure with a cross travel carriage supporting a grinding stand provided on the upper portion of the structure.

At grinding machines of this kind the grinding wheel in many cases is directly connected to its drive motor. At such an arrangement apparently the risk is great that undesirably vibrations and shakings from the drive motor are propagated to the grinding wheel. A grinding wheel assembled with the drive motor also constitutes a great mass, whereby difficulties, for example with respect to the control of the grinding pressure, can arise. The grinding stand mounted on the cross travel carriage provides the possibility of continuous rotation of the grinding wheel, whereby an increase in the width of the groove is obtained. A positive locking of the grinding stand at the cross travel carriage after completion of the desired rotation of the grinding wheel provides optimum stability and low vibrations. These and other advantages are achieved thereby that the grinding machine shows the characterizing features defined in the attached claims.

The invention is described in the following with reference to an embodiment shown in the accompanying drawings.

Figure 1:
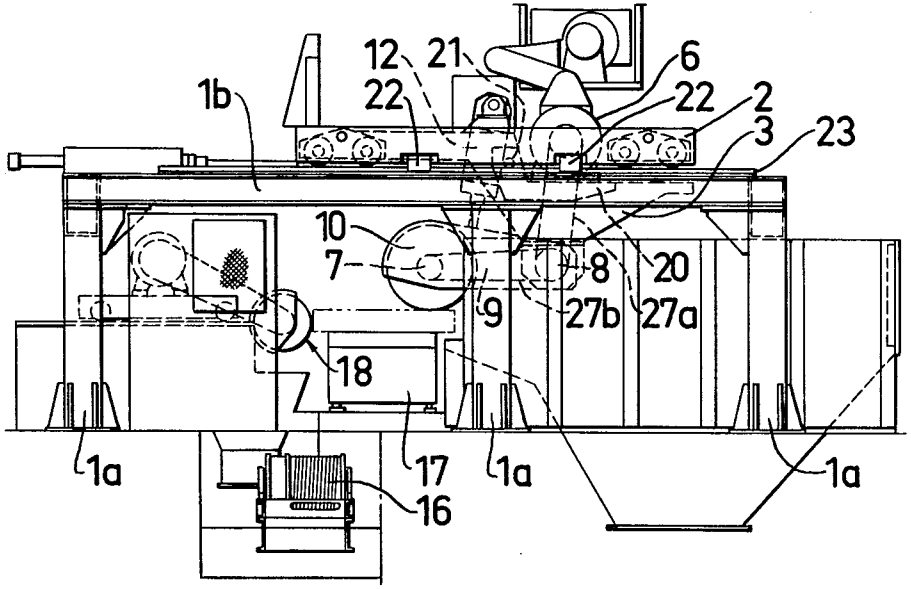
FIG. 1 is a lateral view of the grinding machine with associated grinding table.
Figure 2:
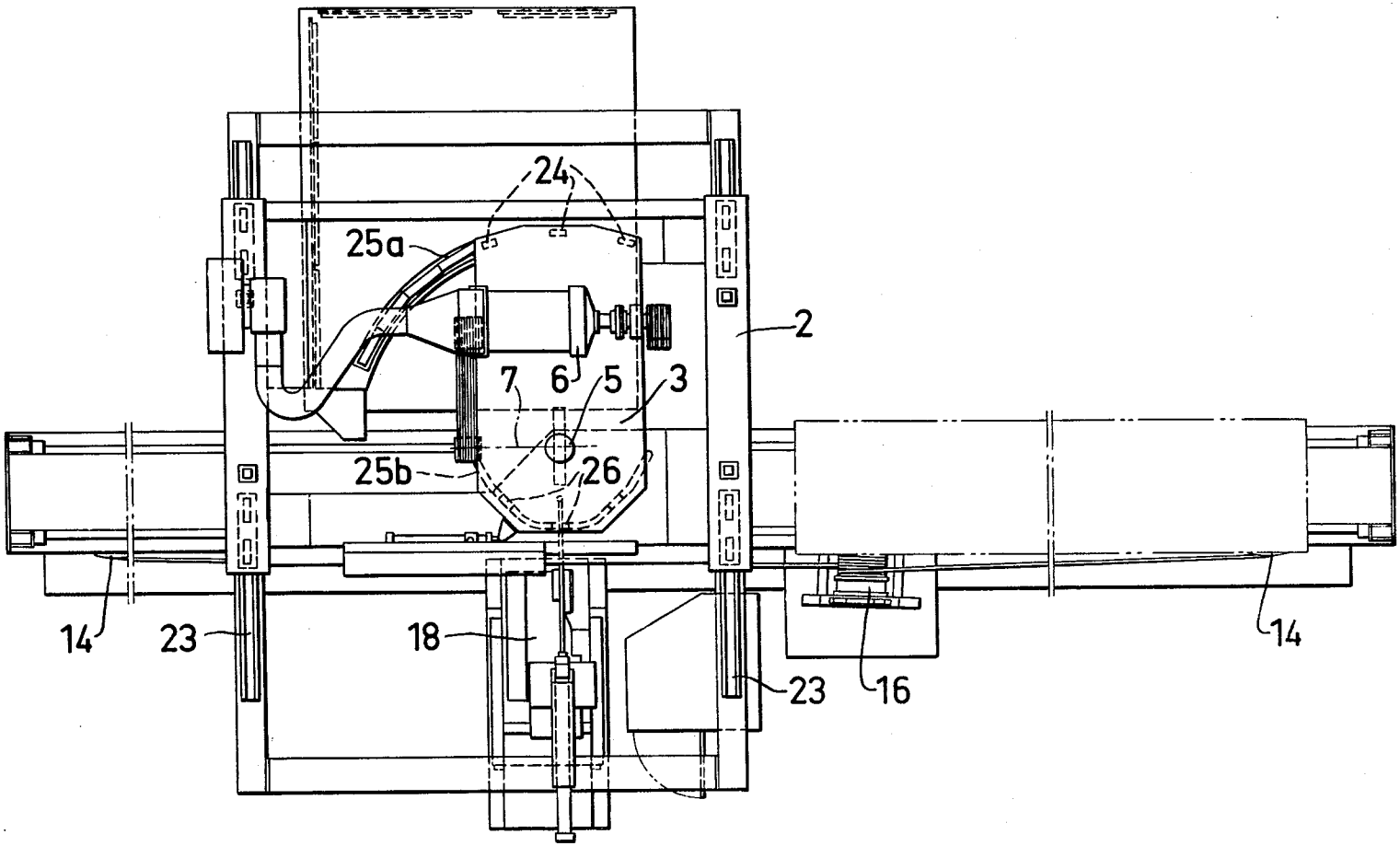
FIG. 2 is a view from above of the grinding machine according to FIG. 1.

The rigid frame structure according to FIG. 1 comprises six columns 1*a* and fastened thereon beams 1*b*, on which rails 23 are mounted. On these rails and movable thereon rests a cross travel carriage 2 and supports the grinding stand 3, which is rotatable in the horizontal plane about a pin 5 located straight above the centre of the grinding spindle 7. The drive motor 6 of the grinding spindle is disposed on a motor cradle 20 about an articulated axle 21 on the grinding stand 3 and, consequently, rotary with the stand and pivotal about the articulated axle. An intermediate shaft 8 at the lower portion of the grinding stand supports the grinding pendulum 9 and a belt pulley mounted on the intermediate shaft 8. The grinding pendulum 7 is driven by the drive motor 6 via a belt transmission 27*a*, 27*b*. The grinding pressure cylinder 12 is supported rotatably in the vertical plane on the grinding stand 3 and actuates the grinding pendulum 9 through a hinge joint. The grinding pressure cylinder controls the adjustment of and the grinding pressure at the grinding wheel and co-operates with a device, which automatically maintains the grinding effect constant. This device comprises an electric system, which records the current consumption of the drive motor 6 as disclosed in detail in the Swedish Pat. No. 326,120. The electric system actuates valves in the hydraulically operated grinding pressure cylinder, which increases or reduces the grinding pressure in order thereby to maintain a constant grinding effect. As the effect and speed of the drive motor 6 can be adjusted, it is possible by a means, which continuously scans the diameter of the grinding wheel, also to increase the speed of the motor when the grinding wheel gets worn, and hereby to maintain a constant circumferential speed of the grinding wheel.

The grinding table 17 supports the workpiece, which together with the grinding table is fed in a direction transverse to the grinding wheel. At the end of each feed movement of the grinding table its speed is decreased and at the same time the grinding pressure is reduced. It is hereby possible to move the cross travel carriage 2, for example by means of a hydraulic cylinder, with the grinding stand 3 and grinding pendulum 9 transverse to the workpiece with maintained cutting efficiency. After completed movement the cross travel carriage is fixed, and the table is reversed at accelerated speed at the same time as the grinding pressure increases until the table has achieved maximum speed. When also the edges of the workpiece are to be ground, an edge grinding unit can be positioned as indicated by the reference numeral 18 in FIG. 1. This unit can be controlled and operated substantially in the same manner as explained in connection with the grinding wheel supported on the grinding pendulum.

In order after its movement in steps to fix the cross travel carriage 2 in its position relative to the rails 23, the carriage is provided with controllable clamping members embracing the rails. Said clamping members may preferably be controlled hydraulically and be actuated automatically in connection with the setting or movement of the cross travel carriage.

The grinding stand 3 supported rotatably in the horizontal plane on the cross travel carriage is provided with wheels 24, 26 and rests on rails 25*a* and 25*b* mounted on the cross travel carriage. The rotation of the grinding stand 3 relative to the cross travel carriage 2 preferably can be effected by actuation of a hydraulic cylinder, which is hingedly connected to the cross travel carriage and the grinding stand. By rotation of the grinding stand which can take place continuously, an increase in the width of the groove is obtained, which results in reduced waste and shorter working time. Clamping members provided for fixing the grinding stand relative to the cross travel carriage after a completed rotation of the grinding stand may be of the same kind as the clamping members fixing the cross travel carriage relative to the rails 23.

The grinding table 17 is supported on guide rails, which are mounted with accurate parallelism on the machine foundation and permit the wheeled grinding table be moved uniformly and without vibrations. The movement of the table 17 is effected by the table drive 16, which is located beneath the machine foundation and comprises a hydraulic motor directly connected to a wire drum. The table 17 is pulled by the wire, which runs from the drum via pulleys 14 at each end of the foundation to the lower portion of the table. One of the pulleys at the foundation acts as an automatic wire stretcher and may be hydraulically operated. At each end of the travel path of the grinding table braking takes place by control of the fluid to and from the hydraulic motor driving the wire drum. The hydraulic motor has a high starting torque and a high driving torque at low speed, so that the table can perform a rapid and soft reversing movement.

Figure 3:
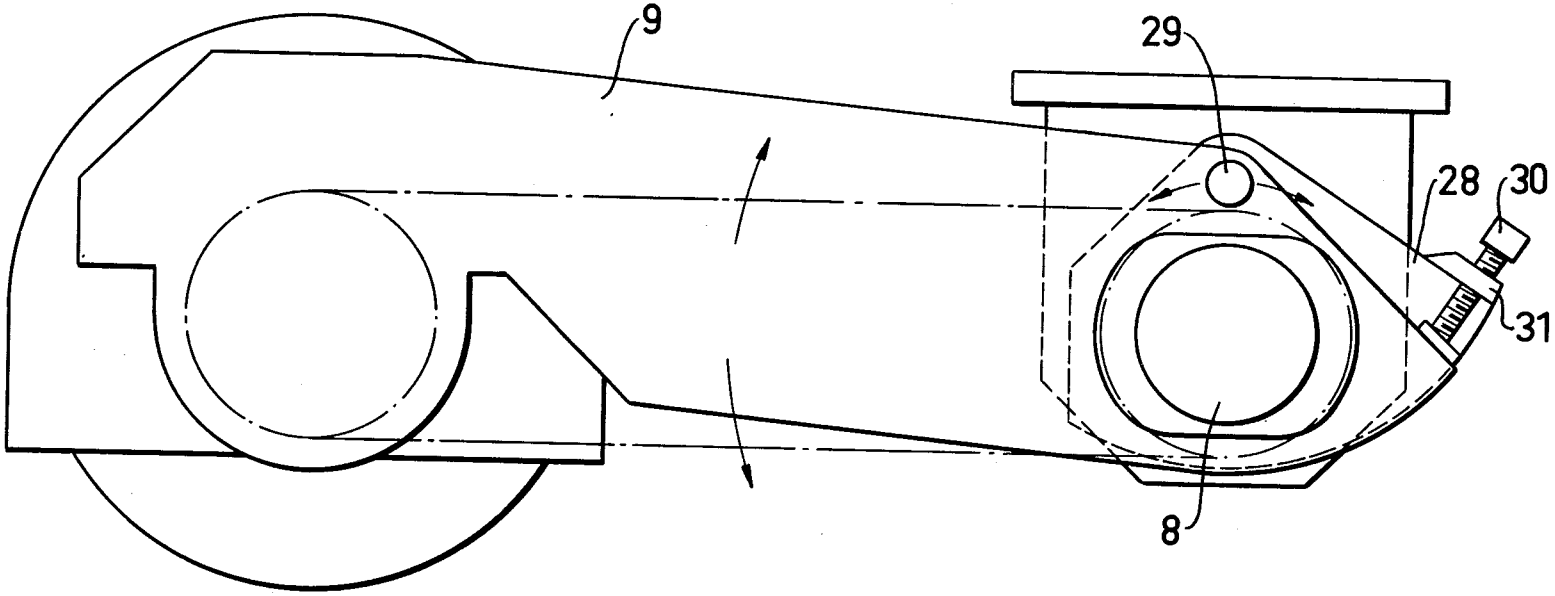
FIG. 3 shows a grinding pendulum and its connection to an intermediate shaft.

In FIG. 3 the attachment of the grinding pendulum 9 to the intermediate shaft 8 is shown. The intermediate piece 28 is rotatory on the intermediate shaft by means of an axle concentric on said shaft. A pin 29 fastened on the intermediate piece carries rotatably the grinding pendulum 9. An adjusting means 30, 31 comprising, for example, a screw and a nut is attached to the intermediate piece 28. The grinding pendulum 9 has a recess for the intermediate shaft 8 which permits relative rotation between the grinding pendulum and the intermediate piece upon actuation of the screw 30 of the adjusting means which with its free end abuts a stop member on the grinding pendulum. The belt pulley on the intermediate shaft is fixed thereon so that the rotation of the grinding pendulum relative to the intermediate piece either reduces or increases the distance between said belt pulley and the belt pulley at the grinding pendulum. This arrangement renders it possible in a simple way to adjust the tension of the drive belt and it also facilitates the exchange of the drive belt between the grinding spindle and intermediate shaft.

What we claim is:

1. A grinding machine which comprises:

a rigid frame structure, a cross travel carriage movably supported on said rigid frame structure, a grinding wheel, a grinding pendulum, and a drive motor, wherein said grinding stand is rotatably supported by said cross travel carriage in the horizontal plane about a pin located straight above center of said grinding wheel by a pivot fixed between said cross travel carriage and said grinding stand and by wheels on said grinding stand which cooperate with rails on said cross travel carriage, and wherein said grinding wheel is supported by a grinding pendulum carried by said grinding stand via an intermediate shaft fastened on said grinding stand, and wherein said drive motor for driving the grinding wheel is rigidly secured on said rotatable grinding stand.

2. A grinding machine according to claim 1, characterized in that clamping members are provided on the grinding stand which are engageable with the rails on the cross travel carriage for fixing the grinding stand relative to the cross travel carriage.

3. A grinding machine according to claim 1, characterized in that at the upper portion of the frame structure rails are mounted, on which the cross travel carriage is movably supported, and that controllable clamping members are provided at the cross travel carriage which can be caused to embrace the rails in order to fix the cross travel carriage thereto.

4. A grinding machine according to claim 1, characterized in that the grinding pendulum supported beneath the grinding stand is rotatable relative to the intermediate shaft through an intermediate piece, that the grinding pendulum and the intermediate piece are rotatably interconnected about a pin positioned eccentrically with respect to the intermediate shaft, and that the grinding pendulum includes an opening for the intermediate shaft which by an adjusting means permits rotation of the grinding pendulum relative to the intermediate piece about the pin for adjusting the centre distance between the grinding wheel and intermediate shaft.

5. A grinding machine according to claim 1, characterized in that a grinding pressure cylinder is hingedly mounted between the grinding stand and the grinding pendulum, and said cylinder is so arranged and actuated that a constant grinding effect continuously is maintained.

* * * * *